US007967407B2

(12) United States Patent
Moscato et al.

(10) Patent No.: US 7,967,407 B2
(45) Date of Patent: Jun. 28, 2011

(54) USE OF A SENSE MARK TO CONTROL A PRINTING SYSTEM

(75) Inventors: Anthony V. Moscato, North Tonawanda, NY (US); Theodore F. Cyman, Jr., Grand Island, NY (US); Frank J. Rocco, North Tonawanda, NY (US)

(73) Assignee: R.R. Donnelley, Chicago, IL (US)

( * ) Notice: Subject to any disclaimer, the term of this patent is extended or adjusted under 35 U.S.C. 154(b) by 674 days.

(21) Appl. No.: 11/701,801

(22) Filed: Feb. 2, 2007

(65) Prior Publication Data

US 2007/0222805 A1 Sep. 27, 2007

Related U.S. Application Data

(60) Provisional application No. 60/765,353, filed on Feb. 3, 2006.

(51) Int. Cl.
*B41J 29/38* (2006.01)

(52) U.S. Cl. ..... 347/14

(58) Field of Classification Search ..... 347/14
See application file for complete search history.

(56) References Cited

U.S. PATENT DOCUMENTS

| | | | |
|---|---|---|---|
| 3,599,229 | A | 8/1971 | Merrell |
| 3,717,722 | A | 2/1973 | Messner |
| 3,803,628 | A | 4/1974 | Van Brimer et al. |
| 3,911,818 | A | 10/1975 | MacIlvaine |
| 3,925,790 | A | 12/1975 | Fishbeck |
| 4,146,900 | A | 3/1979 | Arnold |
| 4,219,822 | A | 8/1980 | Paranjpe |
| 4,238,804 | A | 12/1980 | Warren |
| 4,320,406 | A | 3/1982 | Heinzl |
| 4,401,024 | A | 8/1983 | Frentress |
| 4,463,359 | A | 7/1984 | Ayata et al. |
| 4,477,103 | A | 10/1984 | Bertolazzi |
| 4,593,296 | A | 6/1986 | Dagna |
| 4,611,219 | A | 9/1986 | Sugitani et al. |
| 4,728,968 | A | 3/1988 | Hillmann et al. |
| 4,734,717 | A | 3/1988 | Rayfield |
| 4,736,213 | A | 4/1988 | Piatt et al. |
| 4,789,147 | A | 12/1988 | Berger et al. |
| 4,792,860 | A | 12/1988 | Kuehrle |
| 4,804,979 | A | 2/1989 | Kamas et al. |
| 4,812,859 | A | 3/1989 | Chan et al. |
| 4,835,713 | A | 5/1989 | Pastor |

(Continued)

FOREIGN PATENT DOCUMENTS

| | | |
|---|---|---|
| EP | 317 762 | 5/1989 |

(Continued)

OTHER PUBLICATIONS

International Search Report and Written Opinion, International Application No. PCT/US07/03240 dated Sep. 27, 2007.

(Continued)

*Primary Examiner* — Julian D Huffman
(74) *Attorney, Agent, or Firm* — McCracken & Frank LLP

(57) ABSTRACT

A printing system includes a printer that prints only a sense mark on a substrate and an imaging unit. The imaging unit prints data onto the substrate and includes a plurality of printheads. The printing system also includes a sensor that detects the sense mark and a controller that instructs the imaging unit to print data onto the substrate, wherein the controller distributes print data among the plurality of printheads.

30 Claims, 4 Drawing Sheets

U.S. PATENT DOCUMENTS 4,839,674 A 6/1989 Hanagata et al.
4,847,660 A 7/1989 Wheatley, Jr. et al.
4,878,063 A 10/1989 Katerberg
4,994,975 A 2/1991 Minschart
5,031,530 A 7/1991 Burger
5,069,124 A 12/1991 Schneider
5,079,571 A 1/1992 Eriksen
5,087,805 A 2/1992 Silverschotz et al.
5,102,110 A 4/1992 Reynolds
5,129,568 A 7/1992 Fokos et al.
5,137,304 A 8/1992 Silverschotz et al.
5,160,946 A 11/1992 Hwang
5,224,640 A 7/1993 Fokos et al.
5,266,976 A 11/1993 Ohigashi et al.
5,287,162 A 2/1994 de Jong et al.
5,289,208 A 2/1994 Haselby
5,298,761 A 3/1994 Aoki et al.
5,313,886 A 5/1994 Mueller
5,365,847 A 11/1994 Pers
5,384,592 A 1/1995 Wong
5,408,746 A 4/1995 Thoman et al.
5,434,956 A 7/1995 Son et al.
5,568,168 A 10/1996 Watanabe
5,598,198 A 1/1997 Taylor et al.
5,617,128 A 4/1997 Thoman et al.
5,648,801 A 7/1997 Beardsley et al.
5,688,059 A 11/1997 Clarke et al.
5,689,289 A 11/1997 Watanabe et al.
5,704,282 A 1/1998 Khalid
5,715,498 A 2/1998 Takeuchi et al.
5,765,083 A 6/1998 Shinohara
5,765,481 A 6/1998 Tortora et al.
5,784,077 A 7/1998 Silverbrook
5,793,397 A 8/1998 Barker et al.
5,796,411 A 8/1998 Cyman et al.
5,796,414 A 8/1998 Sievert et al.
5,797,305 A 8/1998 Harrod et al.
5,806,430 A 9/1998 Rodi
5,868,069 A 2/1999 Khalid et al.
5,889,534 A 3/1999 Johnson et al.
5,937,756 A 8/1999 Kishine et al.
5,949,438 A 9/1999 Cyman et al.
5,995,717 A 11/1999 Tanaka
6,003,988 A 12/1999 McCann et al.
6,065,400 A 5/2000 Van Weverberg
6,068,362 A * 5/2000 Dunand et al. ..... 347/16
6,072,587 A 6/2000 Hicks
6,109,722 A 8/2000 Underwood et al.
6,120,142 A 9/2000 Eltgen et al.
6,126,267 A * 10/2000 Ito et al. ..... 347/35
6,146,035 A 11/2000 Ishigouoka et al.
6,213,580 B1 4/2001 Segerstrom et al.
6,224,192 B1 5/2001 Robinson et al.
6,236,463 B1 5/2001 Cyman et al.
6,317,147 B1 11/2001 Tanaka
6,325,480 B1 12/2001 Moghadam et al.
6,334,666 B1 1/2002 Inui et al.
6,375,296 B1 4/2002 McGarry et al.
6,390,588 B1 5/2002 Ikeda
6,409,301 B1 6/2002 Takata et al.
6,411,324 B1 6/2002 Christiansen et al.
6,422,678 B1 7/2002 Serra et al.
6,446,100 B1 9/2002 Warmus et al.
6,450,607 B1 9/2002 Bolash et al.
6,450,614 B1 9/2002 Scheffelin et al.
6,460,441 B1 10/2002 Harrod
6,467,768 B1 10/2002 Vary et al.
6,467,874 B1 10/2002 Williams et al.
6,474,886 B1 11/2002 Sugiyama et al.
6,499,822 B1 12/2002 Abe et al.
6,547,370 B2 4/2003 Mantell et al.
6,599,040 B2 7/2003 Nakazawa et al.
6,622,621 B2 9/2003 Bucher et al.
6,637,860 B1 10/2003 Madeley
6,644,773 B2 11/2003 Bildstein et al.
6,663,206 B2 12/2003 Taylor
6,682,163 B2 1/2004 Metzler et al.
6,688,721 B1 2/2004 Serra
6,712,444 B2 3/2004 Abe et al.
6,763,220 B2 7/2004 Nakazawa
6,789,870 B2 9/2004 Barnes et al.
6,891,630 B1 5/2005 Miyasaka et al.
6,909,516 B1 6/2005 Hoover
7,013,803 B2 3/2006 Hansen et al.
7,014,289 B1 3/2006 Matsuda
7,021,732 B2 4/2006 Folkins
7,021,738 B2 4/2006 Juan et al.
7,061,630 B2 6/2006 Murray
7,168,784 B2 1/2007 Donovan et al.
7,209,600 B2 4/2007 Goldberg
7,216,952 B2 5/2007 Claramunt et al.
7,242,494 B2 7/2007 Hanazato
7,251,437 B2 7/2007 Tamoto et al.
7,309,118 B2 12/2007 Mizes et al.
7,543,911 B2 6/2009 Mizes et al.
2002/0075505 A1 6/2002 Murray
2002/0167554 A1 11/2002 Parry
2003/0234959 A1 12/2003 Goldberg
2004/0115344 A1 * 6/2004 Newsome et al. ..... 427/162
2005/0073539 A1 4/2005 McGarry et al.
2005/0078137 A1 4/2005 Juan et al.
2005/0185009 A1 8/2005 Claramunt et al.
2005/0286915 A1 12/2005 Butikofer
2006/0039015 A1 * 2/2006 Kageyama et al. ..... 358/1.5
2006/0114283 A1 6/2006 Mizes et al.
2006/0139392 A1 6/2006 Fernandez et al.

FOREIGN PATENT DOCUMENTS

EP 319 223 6/1989
EP 835 761 4/1998
EP 1 522 411 4/2005
FR 2 605 268 4/1988
JP 8-143182 6/1996
JP 2004-112045 4/2004
WO 2007092490 8/2007

OTHER PUBLICATIONS

International Preliminary Report on Patentability for Application No. PCT/US07/03240 dated Aug. 14, 2008.
Search Report in EP 07 76 3655 dated Jan. 5, 2009.
International Search Report and Written Opinion in PCT/US2008/008115 dated Jan. 20, 2009.
International Preliminary Report on Patentability for Application No. PCT/US2008/008115 dated Jan. 14, 2010.
Preliminary Amendment in EP Application No. 07763655.3 dated Mar. 28, 2008 (11 pages).
Supplemental European Search Report in EP Application No. 07763655.3 dated Feb. 3, 2009 (10 pages).
Response to Official Letter in EP Application No. 07763655.3 dated Jul. 27, 2009 (16 pages).
Notice of Patent Grant in EP Application No. 07763655.3 dated Nov. 18, 2009 (25 pages).
Int'l Preliminary Report on Patentability and Written Opinion for Application No. PCT/US2008/008115 dated Jan. 4, 2010.

* cited by examiner

USE OF A SENSE MARK TO CONTROL A PRINTING SYSTEM

CROSS REFERENCE TO RELATED APPLICATIONS

This application claims the benefit of U.S. Provisional Application Ser. No. 60/765,353, filed Feb. 3, 2006, and incorporated herein by reference in its entirety.

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present invention relates generally to printing systems and more particularly to high-speed printing systems that use a sense mark on a substrate to control the printing of images or data on the substrate.

2. Description of the Background of the Invention

High-speed printing systems typically print on a paper web by moving the paper web along a paper path using rollers or drums past printheads. A controller controls the printheads to print images on the paper web as the paper web moves under and/or over the printheads. In printing systems that include multiple imaging units, each imaging unit may include a plurality of printheads and each imaging unit may print a different color on the paper web. A first imaging unit prints a first color used for an image and a subsequent imaging unit prints a second color overlaid on the same image and so on with additional imaging units and colors. In order to align the printed images, it is important to track the position of the printed images with respect to the printheads included in each imaging unit.

In high-speed printing systems, the speed at which the paper web is moving along the paper path can be on the order of hundreds of feet/meters per second. In addition, the paper web dimensions may change due to moisture and other forces exerted on the paper web. These and other factors make it difficult to accurately track the position of the paper web and provide accurate control of the printheads.

Prior print systems and methods have included the printing of a sense mark on the substrate that indicates a top of the page. A sensor detects the sense mark and a controller tracks the position of the sense mark with respect to the printheads on each imaging unit. The controller instructs the printheads to print on the paper web in accordance with the detection of the sense mark. Prior print systems use a first printhead on a first imaging unit to print the sense mark on the paper web. Consequently, the sense mark is located along a side margin of the paper web, where subsequent images are not printed. This arrangement requires a larger paper web width to produce a printed image of a particular size because of the unused margin where the sense mark is printed. Further, these prior systems have not adequately addressed the issue of accurately detecting the sense mark and tracking the paper web.

SUMMARY OF THE INVENTION

In one embodiment, a printing system includes a printer that prints a sense mark on a substrate and an imaging unit.

The imaging unit prints data onto the substrate and includes a plurality of printheads positioned around the circumference of a drum associated with the imaging unit. The substrate is fed onto the drum is driven past the plurality of printheads by the rotation of the drum. The printing system further includes a single sensor associated with the plurality of printheads that detects the sense mark at a position where the substrate is in contact with the drum and a controller that instructs the imaging unit to print data onto a portion of the substrate that is in contact with the drum, wherein the controller distributes print data among the plurality of printheads in accordance with the detection of the sense mark by only the single sensor.

In another embodiment, a method of printing includes the step of printing a plurality of sense marks on a substrate, wherein consecutive sense marks are separated by a predetermined distance. The method further includes the step of feeding the substrate onto a drum associated with the imaging unit, wherein the imaging unit includes a plurality of printheads positioned around a circumference of the drum. Additionally, the method includes the steps of driving the substrate past the plurality of printheads by the rotation of the drum, detecting the sense marks with a single sensor associated with the plurality of printheads at a position where the substrate is in contact with the drum and instructing an imaging unit to print images onto a portion of the substrate that is in contact with the drum, wherein the instructing step distributes print data among the plurality of printheads in the imaging unit in accordance with the detection of the sense marks by only the single sensor.

In yet another embodiment, a printing system includes a sense mark printer that prints only a plurality of sense marks on a paper web, wherein consecutive sense marks are separated by predetermined distances, and an imaging unit that prints images on the paper web, wherein the imaging unit includes a plurality of printhead assemblies. The printing system further includes a drum that drives the paper web past the printhead assemblies, a single sensor associated with the plurality of printhead assemblies that detects the sense marks after the paper web has contacted the drum, and a controller. The controller instructs the printhead assemblies to print images onto the paper web, wherein the controller tracks the position of multiple sense marks concurrently and accounts for the speed of the paper web so that the printhead assemblies print images onto the paper web in accordance with the sense marks by only the single sensor.

Other aspects and advantages of the present invention will become apparent upon consideration of the following detailed description.

DETAILED DESCRIPTION OF THE PREFERRED EMBODIMENTS

Figure 1:
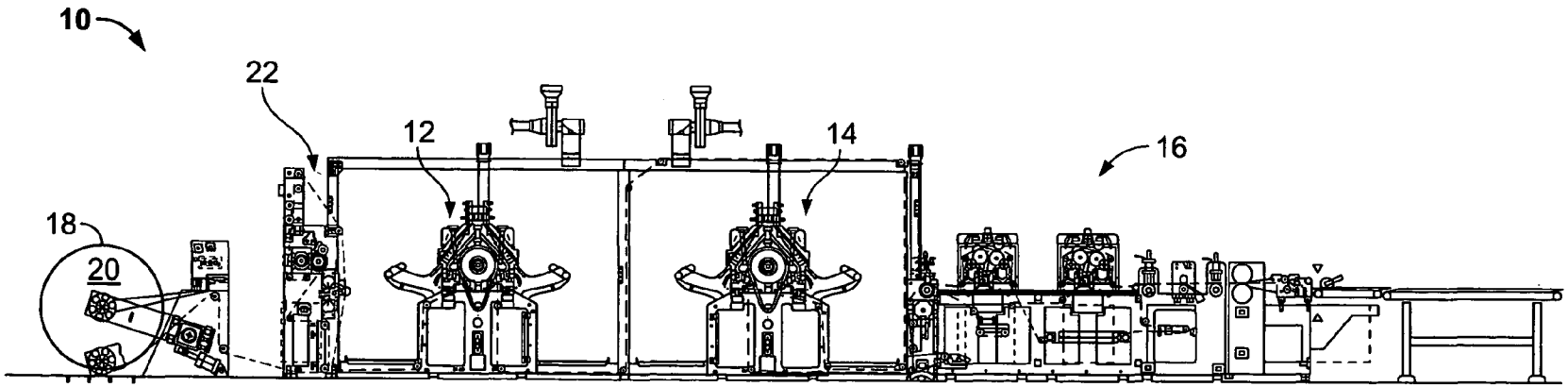
FIG. 1 is a side elevational view of a printing system according to an embodiment.

FIG. 1 shows an embodiment of a printing system 10 configured with two imaging units 12, 14 and finishing systems 16 downstream of the imaging units. A paper web 18 arranged in a roll 20 is fed through the imaging units 12, 14 and finishing systems 16. A sense mark printer 22 upstream from the imaging units 12, 14 prints a sense mark on the paper web 18. The first imaging unit 12 prints on a first or front side of the paper web 18 and the second imaging unit 14 prints on a second or back side of the paper web. A plurality of cylinders and turn-bars (shown in more detail in FIGS. 3, 5, and 6) controls the paper path through the printing system 10 so that the paper web 18 need not be turned to permit duplex printing. If desired, only a single imaging unit is provided to enable simplex printing. In another embodiment, a single imaging unit is used for duplex printing by feeding the paper web through the imaging unit a first time to print on a first side of the paper web, turning the paper web, and feeding the paper web through the imaging unit a second time to print on the second side. Additional imaging units may be included to print in additional colors.

Figure 2B:
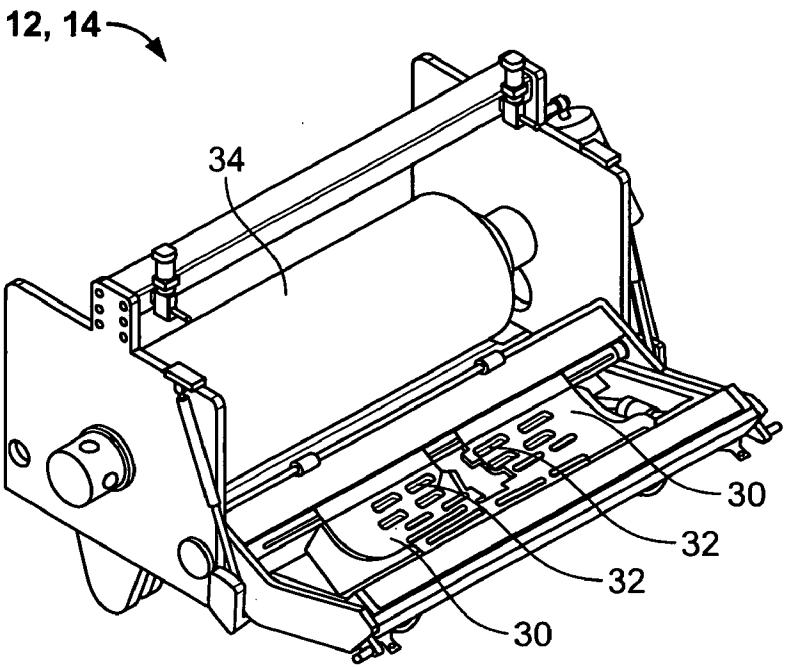
FIG. 2B is a another diagrammatic view of the imaging unit of FIG. 2A.
Figure 2A:
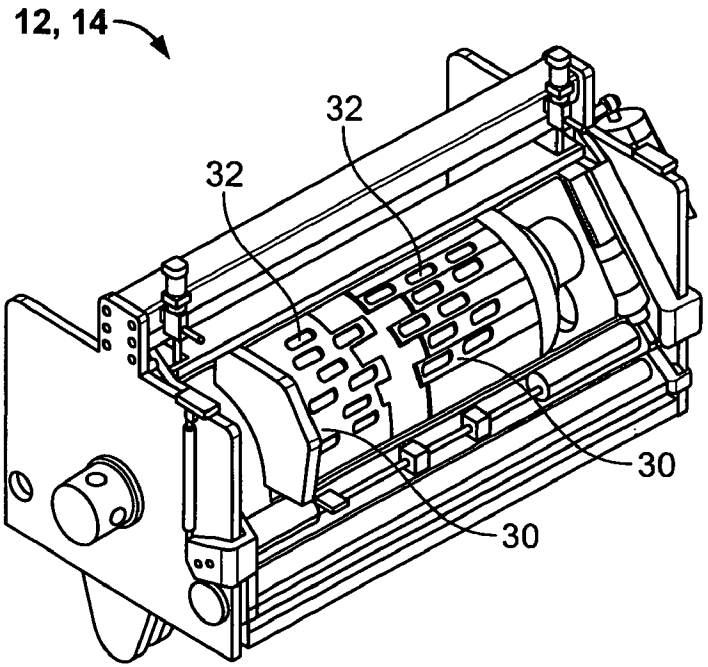
FIG. 2A is a diagrammatic view of an imaging unit used in the printing system of FIG. 1.

FIGS. 2A and 2B show one side of the imaging units 12, 14 including two printhead assemblies 30, wherein each printhead assembly includes one or more slots 32 for receiving inkjet printheads or cartridges (not shown). Examples of suitable printheads are those used in desktop printers or plotters. The printhead assemblies 30 can be positioned around a drum 34 that rotates and drives a paper web past the printhead assemblies. A controller (not shown) stores the position of one or more printheads in the slots 32 with respect to the drum. As the drum 34 rotates and the paper web 18 passes under the printheads, the controller instructs the printheads to print images on the paper web. The controller divides a raster line among the plurality of printheads in accordance with the position of the paper web with respect to the individual printheads. Each printhead assembly 30 prints one color such that a first color of an image is printed; a second color of the image is overprinted on the first color, and so on. In other embodiments, each printhead assembly can print more than one color, wherein individual printheads in each printhead assembly print a single color.

Generally, the imaging units 12, 14 contain four printhead assemblies, two on each side of the imaging unit, wherein each printhead assembly includes a plurality of printheads. The printhead assemblies 30 are positioned to guarantee that the direction of travel of a drop of ink from each printhead is substantially perpendicular to the surface of the associated drum 34 (and hence the paper web 18).

In the embodiment of FIGS. 2A and 2B, each printhead assembly 30 has the ability to print an image that is up to 12 inches (30.48 cm) wide. Further, two printhead assemblies 30 are axially positioned relative to one another so that the print width spans the width of the paper web 18 (typically 24 inches or 60.96 cm). This permits a printing width of up to 24 inches (60.96 cm). In this way, the imaging unit 12, 14 can print 2-up 8½×11 inch (21.59×27.94 cm) pages in either landscape or portrait fashion. Other page heights or widths could be produced in N-up fashion, if desired.

The printing system in other embodiments includes a series of modular units that can be utilized as needed for the printing task to be undertaken. In other words, each imaging unit may include only two printhead assemblies (one on the left half of the imaging unit and another on the right half of the unit) and the same or different inks may be fed to each printhead assembly so that each assembly can print one side of a 12-inch (30.48 cm) page. As noted above, each imaging unit may further include two additional printhead assemblies. The additional assemblies are positioned to overprint the color(s) deposited by the first two printhead assemblies. In this configuration, each imaging unit can simultaneously print two simplex 12 inch (30.48 cm) pages in two different colors. Two such imaging units operating in series can produce two simplex 12 inch (30.48 cm) four-color pages and four imaging units can produce two duplex 12 inch (30.48 cm) four-color pages. In addition, as noted above, depending upon the number of imaging units that are used, one could alternatively produce 24-inch (60.96 cm) simplex or duplex pages in one to four colors.

Figure 3:
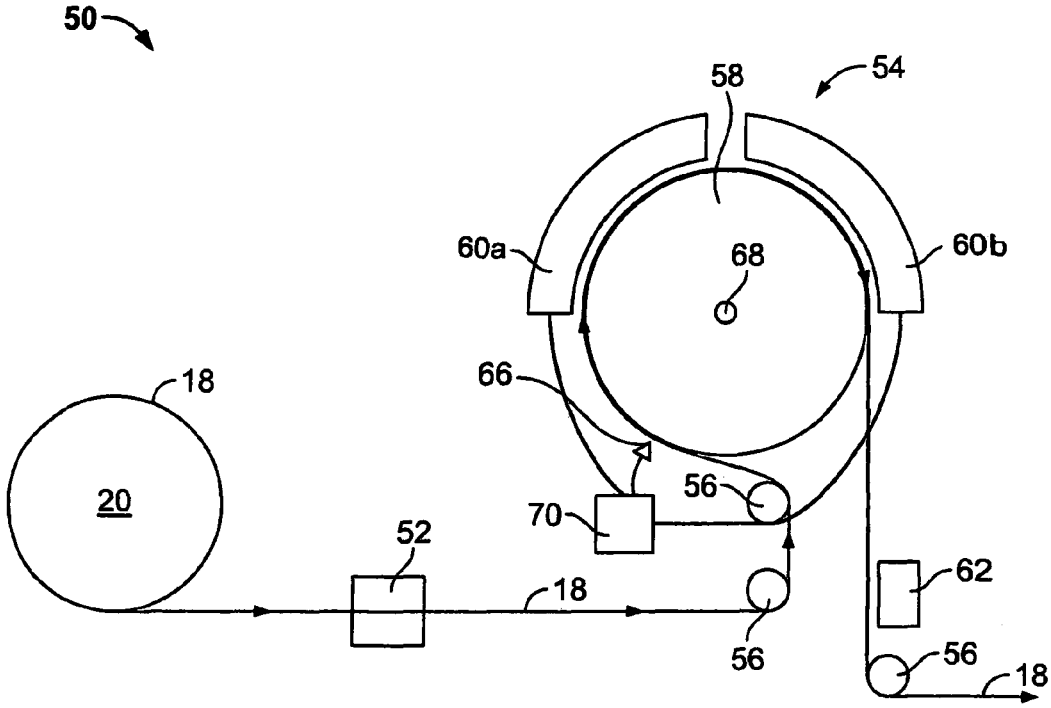
FIG. 3 is a diagrammatic view of a printing system according to yet another embodiment.

As seen in FIG. 3, a printing system 50 includes the paper web 18 arranged in the roll 20 that is driven through a sense mark printer 52 and then through an imaging unit 54 that prints images onto the paper web. Tension cylinders and turn-bars 56 are used to control the travel of the paper web 18 through the printing system 50. The paper web 18 contacts a drum 58 in the imaging unit 54 and the rotation of the drum drives the paper web past left and right printhead assemblies 60*a*, 60*b*, respectively. A frictional force between the drum 58 and the paper web 18 maintains a stable surface interface between the paper web and the drum as the paper web is being driven by the rotating drum. Generally, the frictional force will be sufficient so that the paper web does not slip while it is in contact with the drum. However, in other embodiments, the surface of the drum may be textured to increase the frictional force. In yet other embodiments, any appropriate system using tension cylinders, turn-bars, rotating drums, etc. can be used to deliver the paper web past the printheads.

In FIG. 3, the paper web 18 is in contact with the drum 58 along a majority of the circumference of the drum. This arrangement provides a stable non-slip surface interface between the paper web 18 and the drum 58 as the paper web is driven past the printheads in each printhead assembly 60*a*, 60*b*. Consequently, the position of the paper web 18 relative to each printhead can be calculated using the angular speed of the drum and the elapsed time. Also, the stable non-slip surface interface counteracts the tendency of the paper web to deform as ink is applied to the surface of the web. In one embodiment, the paper web 18 is in contact with the surface of the drum 58 along greater than 180 degrees. In another embodiment, the paper web 18 is in contact with the surface of the drum 58 along about 270 degrees. Consequently, the tension cylinders and turn-bars 56 can be arranged so that the paper web 18 first contacts the drum 58 near the bottom of the drum or along a substantially horizontal tangent line.

In FIG. 3, the paper web 18 is allowed to separate from the drum 58 at a position after the right printhead assembly 60*b*. The paper web separates from the drum along a substantially vertical tangent line and moves down into a drying station 62. The drying station 62 can include any appropriate type of drying device that removes moisture from the paper web 18 before the paper web is sent to downstream imaging units and/or finishing systems. For example, in some embodiments, a blower is used to pass air over the paper web or an infrared heater is used to dry the ink. As the paper web 18 separates from the drum 58, the ink on the paper web is still wet. In the embodiment of FIG. 3, the paper web 18 separates from the drum 58 and moves into the drying station 62 before the paper web contacts another tension cylinder or turn-bar 56. This arrangement allows the ink to dry while the paper web is in a substantially non-tensioned state. Consequently, the effects of paper deformation due to moisture from the ink can be minimized.

Figure 4:
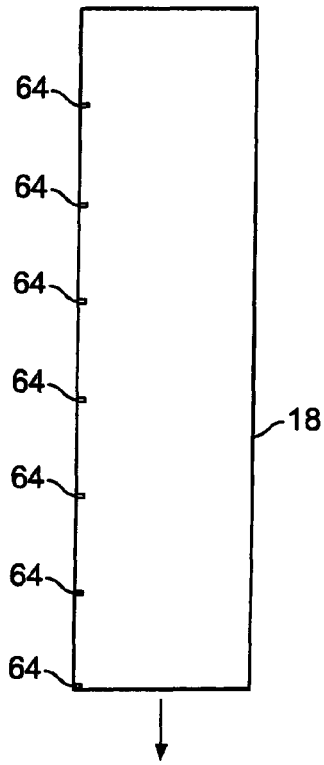
FIG. 4 is diagrammatic view of an embodiment of a sense mark on a paper web.

The sense mark printer 52 is located upstream from the imaging unit 54 to print a sense mark 64 (FIG. 4) on the paper web at a position corresponding to the top of each printed page. FIG. 4 shows an embodiment of a sense mark 64 printed on a paper web 18, wherein the arrow indicates the forward direction in which the paper web moves through the print system. In FIG. 4, the sense mark 64 indicates a top of a form and is located along a side edge of the paper web 18. In other embodiments, the sense mark can indicate a bottom of a form or indicate some other portion of the form so long as the sense mark serves as a reference point for the printing of other images. Additionally, in other embodiments, the sense mark need not be printed along an edge of the paper web, but can be printed anywhere along the width of the web.

The sense mark printer 52 prints a plurality of sense marks 64 on the paper web 18, wherein consecutive sense marks are separated by a predetermined distance depending on the size of the finished page. Any type of ink may be used to print the sense mark; however, generally an ink is chosen that is both relatively inexpensive and easily detected by the sensor 66. In addition, the separate printer 52 uses an inexpensive printhead to print the sense mark 64 on the paper web 18. The embodiment of FIG. 3 gives greater latitude over printing systems that print a sense mark on a paper web using a dedicated first printhead, wherein a wider paper web is used to print a given finished product size, because the imaging units cannot print in the column where the sense mark is located. In contrast, using a separate printer that includes a relatively inexpensive printhead to print the sense mark on the paper web enables subsequent imaging units to print across the entire width of the paper web, including the column where the sense mark is located.

The sensor 66 associated with the imaging unit 54 detects the sense mark 64, and a sensor 68 associated with the drum 58 is used to track the speed and/or the position of the drum (and thus the paper web 18) as the drum rotates. In one embodiment, the sensor 68 associated with the drum 58 is a transducer located on the drum itself. In another embodiment, the sensor 66 that detects the sense mark 64 is a conventional optical sensor. For example, the optical sensor may include a light emitting diode ("LED"), a photodiode, and an amplifier, wherein the LED reflects light off of the substrate and the reflected light is detected by the photodiode to generate a sense signal when the light is reflected off of the sense mark. The sense signal is amplified and supplied to a control circuit 70, which controls the printheads in each printhead assembly 60*a*, 60*b* to print images onto the paper web 18.

In other embodiments, the sense mark printer 52 prints a plurality of sense marks 64 on the paper web using infrared inks that absorb infrared light or invisible inks that reflect ultraviolet light. In these embodiments, the sensor 66 will be adapted to detect the infrared or invisible inks.

The size of the sensor 66 and the size of the sense mark 64 can be adjusted so that the sensor can easily detect the sense mark. For example, the length and/or the width of the sense mark 64 can be matched to the dimensions of the sensor 66. In one embodiment, the sense mark 64 is about ⅛ of an inch (0.3175 cm) in the direction that the paper web 18 is traveling and ¼ to ⅜ of an inch (0.635-0.9525 cm) across the width of the paper web.

In FIG. 3, the sensor 66 is located at a position after the paper web 18 has contacted the drum 58. At this point, the surface contact between the paper web 18 and the surface of the drum 58 is stable and the effects of paper deformation are minimized. In addition, the relatively large contact area between the paper web 18 and the drum 58 further stabilizes the interface between the substrate and the drum so that the rotating drum drives the paper web without slipping. The sensor 66 detects the sense mark 64 at a point after which the paper web 18 has contacted the drum 58 to accurately control the printheads in each printhead assembly 60*a*, 60*b*.

The controller 70 associated with each printhead assembly 60*a*, 60*b* controls the printheads thereof so that the color components of the images are printed substantially in synchronism with the sense marks 64 and the registration or alignment of the color components of the images is accurately controlled. That is, the controller 70 receives a signal from the sensor 66 that the sense mark 64 has been detected and uses the speed and/or position of the drum 58, and hence the speed and/or position of the paper web 18, to control the respective printheads to print a raster line at a particular position of the paper web. The controller 68 then distributes segments of a raster line among the printheads in accordance with the position of each inkjet printhead. Each printhead has local circuitry (not shown) to translate the digital raster line data into analog signals that generate drops of ink deposited onto the paper web 18.

In another embodiment, the controller 70 electronically compensates for inherent delays in the sensor 66 and other electrical components. The controller 70 builds in an electronic delay before sending instructions to the printheads to print raster lines on the paper web 18. The electronic delay will vary depending on the speed of the paper web 18. For example, at full speed a shorter delay may be built in than at a slower speed. Consequently, the controller 70 instructs the printheads to begin printing on the paper web 18 at consistent distances from the sense mark 64.

The controller 70 stores and tracks the positions of a plurality of consecutive sense marks 64 to control the printing of each page moving past the printhead assemblies 60*a*, 60*b*. In one example, consecutive sense marks are separated by a short distance and the finished page size is small so that multiple pages are being printed by a single printhead assembly at the same time. The paper web 18 contacts the drum and the sensor 66 detects a first sense mark 64. The sensor 66 sends a detect signal to the controller 70, which stores the timing of the detect signal and tracks the position of the sense mark. At the appropriate time, the controller 70 instructs the printheads of the left printhead assembly 60*a* to begin printing the first page. While the first page is being printed, the drum 58 continues to rotate and the sensor 66 detects and the controller 70 tracks a second sense mark 64. The controller 70 instructs the printheads to begin printing the second page as the first page is being printed by the same left printhead assembly 60*a*. The drum 66 continues to drive the paper web 18 and consecutive sense marks are detected and tracked to control the printing of each page. After the left printhead assembly 60*a* has printed an image on the first page, the controller 70 continues to track the position of the first sense mark so that the right printhead assembly 60*b* can be controlled to print an image that is aligned with the image printed by the first printhead assembly. Likewise, the positions of consecutive sense marks are tracked to control the alignment of images printed by the left and right printhead assemblies 60*a*, 60*b*. Consequently, printed images can be aligned with the sense marks and with other images.

Figure 5:
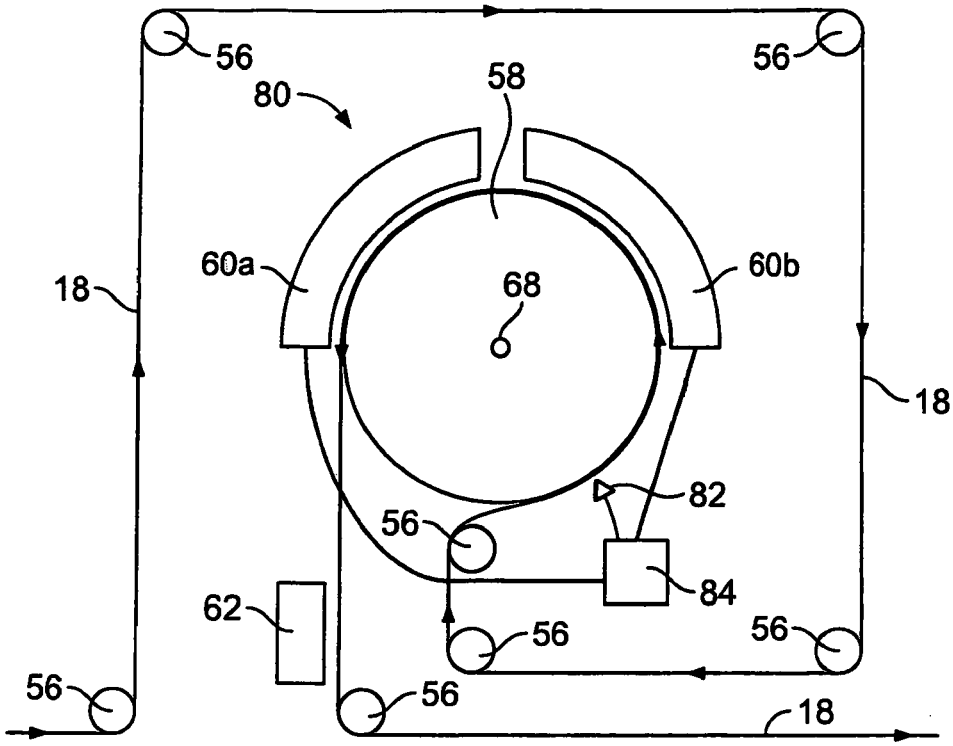
FIG. 5 is a diagrammatic view of a duplex printing system according to an embodiment.

Referring to FIG. 5, in yet another embodiment, the printing system 50 of FIG. 3 is adapted to print in duplex by adding a second imaging unit 80 downstream of a first imaging unit (not shown) that prints on a back side of the paper web after the first imaging unit prints on a front side of the paper web. The first imaging unit operates similarly to the embodiment of FIG. 3 and the second imaging unit 80 is substantially similar to the imaging unit 54 in FIG. 3. In FIG. 5, the paperpath of an imaging unit 80 is illustrated, wherein the paperpath is controlled by a number of tension cylinders or turn-bars 56 that feed the paper web 18 to the imaging unit 80 so that the back side of the paper web is printed. In particular, the paper web 18 is fed onto the drum 58, which is rotating in an opposite direction than the drum in FIG. 3, so that the paper web first moves past the right printhead assembly 60*b* and then past the left printhead assembly 60*a*. Alternatively, the first and second imaging units 54, 80 may be identical, wherein the second imaging unit is merely rotated 180 degrees so that the drums 58 of both imaging units are rotating in the same relative direction, i.e., clockwise, and the paper web moves past the left printhead assembly 60*a* first and then past the right printhead assembly 60*b*. As shown in FIG. 5, the paper web 18 contacts the drum near the bottom of the drum, i.e., along a substantially horizontal tangent line. In addition, the paper web 18 is allowed to separate from the drum 58 and moves down into a drying station 62 similarly to FIG. 3.

In the duplex printing system of FIG. 5, the separate printer 52 upstream from the imaging units 54, 80 prints a sense mark 62 on the front and back sides of the paper web 18. The sense mark 64 on the front side is used to control the respective printheads of the first imaging unit 54 in a manner similar or identical to that described above. The addition of the sense mark 64 on the back side of the paper web 18 is used to control the respective printheads of the second imaging unit 80 to print on the back side of the paper web. Referring to FIG. 5, a sensor 82 associated with the imaging unit 80 is located to detect the sense mark 64 at a position after which the paper web 18 has contacted the drum 58. The sensor 82 is connected to a controller 84 associated with each printhead assembly 60*a*, 60*b*, wherein the controller instructs the printheads in each printhead assembly to print images on the paper web 18 in accordance with the detection of the sense mark 64 and the position of the paper web. The sense mark 64 printed on the back side of the paper web 18 is aligned with the sense mark printed on the front side so that the images printed on the front and back sides are likewise aligned.

Figure 6:
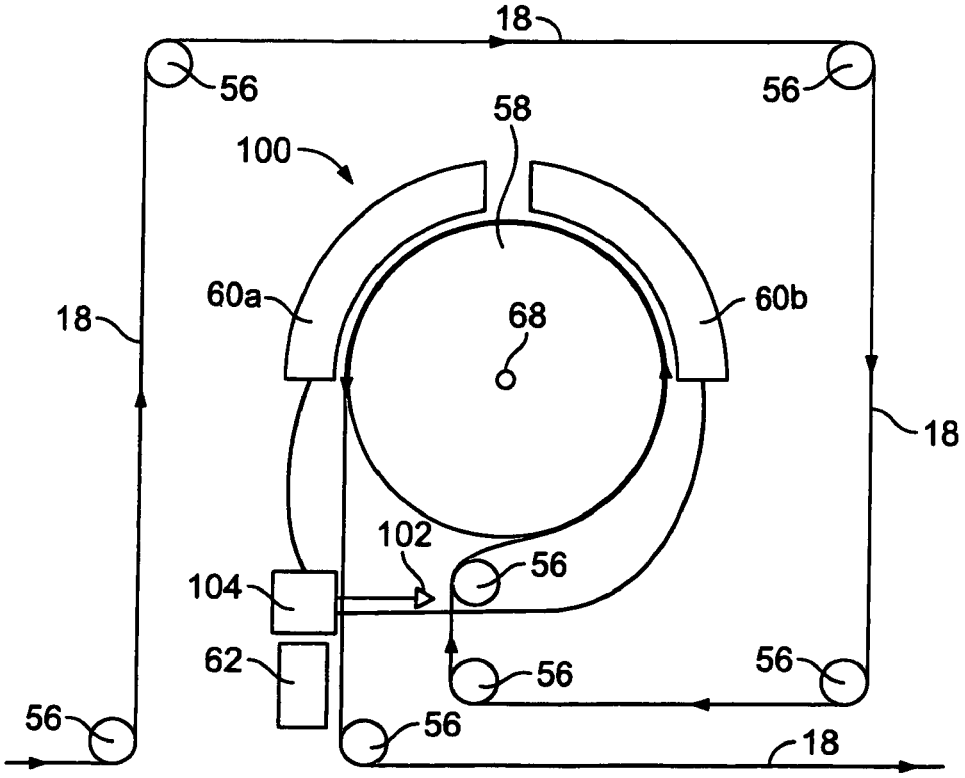
FIG. 6 is a diagrammatic view of a duplex printing system according to another embodiment.

FIG. 6 shows an embodiment of a duplex printing system similar to FIG. 5, wherein the first printer 52 prints a sense mark only on the front side of the paper web 18. In this embodiment, the first imaging unit 54 includes a sensor 66 that detects the sense mark 64 and controls the respective printhead assemblies 60*a*, 60*b* as described previously. Referring to FIG. 6, a second imaging unit 100 includes a sensor 102 that is located to detect the sense mark 64 at a position immediately before the paper web 18 contacts the drum 58. Consequently, the sensor 102 is used to detect the sense mark 64 on the front side of the paper web 18. The detection of the sense mark 64 by the sensor 102 is communicated to a controller 104 that tracks the positions of multiple sense marks and instructs the respective printheads on each printhead assembly 60*a*, 60*b* to print images on the back side of the paper web 18. The large contact area between the paper web 18 and the drum 58 ensures a stable surface interface and an accurate determination of the position of the sense mark 64 and the paper web with respect to the printheads. The controller 104 accounts for the position at which the sensor is located so that the printheads can be accurately controlled.

A further embodiment of a duplex printing system is similar to the previously described embodiments and includes the sense mark printer upstream 52 from first and second imaging units, wherein the sense mark printer only prints a sense mark on the front side of the paper web 18. The first imaging unit detects the sense mark as described above. The second imaging unit is similar to FIG. 5 and includes a sensor that detects the sense mark on the paper web 18 at a position after which the paper web has contacted the drum 58. However, in this embodiment, a sensor used in the second imaging unit is capable of detecting the sense mark on the front side of the paper web through the paper web. For example, a sensitive photomultiplier type light detector may be used in the sensor to detect the sense mark through the paper web. Consequently, a single sense mark can be used to control printheads in a duplex printing system, wherein a relatively inexpensive optical sensor can be used in the first imaging unit and a more sensitive optical sensor can be used in the second imaging unit. Alternatively, the sense mark is printed only on one side of the paper web using infrared or invisible inks, wherein appropriate sensors can detect the marks through the paper web.

The previously described embodiments have included a separate printer to print a sense mark on a paper web and a sensor that detects the mark, wherein the detection of the mark is used to control printheads that print images on the paper web. It will be apparent to one of skill in the art upon reading this document that other systems and methods of using a sense mark to control printing on a substrate are contemplated and fall within the scope of the disclosure.

INDUSTRIAL APPLICABILITY

This invention is useful in controlling printheads to print images on a substrate that are aligned with a sense mark.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out the same. The exclusive rights to all modifications that come within the scope of the appended claims are reserved.

We claim:

1. A printing system, comprising:

a printer that prints a sense mark on a substrate;

an imaging unit that prints data onto the substrate, wherein the imaging unit includes a plurality of printheads;

a drum associated with the imaging unit, wherein the plurality of printheads are positioned around a circumference of the drum and the substrate is fed onto the drum and driven past the plurality of printheads by the rotation of the drum;

a single sensor associated with the plurality of printheads that detects the sense mark at a position where the substrate is in contact with the drum; and a controller that instructs the imaging unit to print data onto a portion of the substrate that is in contact with the drum, wherein the controller distributes print data among the plurality of printheads in accordance with the detection of the sense mark by only the single sensor.

2. The printing system of claim 1, wherein the printer prints a plurality of sense marks on the substrate, and wherein consecutive sense marks are separated by a predetermined distance.

3. The printing system of claim 2, wherein the sense marks indicate a top of page or a bottom of page.

4. The printing system of claim 2, wherein the controller distributes the print data among the plurality of printheads in accordance with the detection of the sense marks and the angular position of the drum.

5. The printing system of claim 4, wherein the controller tracks the positions of multiple sense marks and distributes portions of a raster line among the plurality of print heads in accordance with the positions of the sense marks.

6. The printing system of claim 2, wherein the substrate is a paper web that is fed onto the drum.

7. The printing system of claim 6, wherein the imaging unit is capable of printing data on substantially the entire width of the paper web including the portion wherein the sense marks are printed.

8. The printing system of claim 6, further comprising a second imaging unit that prints data onto the substrate subsequent to the first imaging unit, wherein the second imaging unit includes a plurality of printheads;

a second drum associated with the second imaging unit, wherein the paper web is fed onto the second drum;

and a second sensor that detects the sense marks at the second imaging unit;

and wherein the controller distributes print data among the plurality of printheads of the second imaging unit in accordance with the detection of the sense marks so that the data printed by the second imaging unit is aligned with the data printed by the first imaging unit.

9. The printing system of claim 8, wherein the first imaging unit prints data on a front side of the paper web and the second imaging unit prints data on a back side of the paper web, and wherein the sense marks are detected by the second sensor before the paper web contacts the second drum.

10. The printing system of claim 8, wherein the first imaging unit prints data on a first side of the paper web and the second imaging unit prints data on a back side of the paper web, and wherein the printer prints sense marks on both sides of the paper web and the sense marks are detected by the second sensor after the paper web contacts the second drum.

11. The printing system of claim 8, wherein the first imaging unit prints data on a first side of the paper web and the second imaging unit prints data on a back side of the paper web, and wherein the printer prints the sense marks on only one side of the paper web in infrared or invisible ink, and the sense marks are detected by the second sensor after the paper web contacts the second drum.

12. The printing system of claim 6, wherein the paper web is in contact with the surface of the drum along greater than 180 degrees.

13. The printing system of claim 12, wherein the paper web is in contact with the surface of the drum along about 270 degrees.

14. The printing system of claim 13, wherein the paper web first contacts the drum along a substantially horizontal tangent line and separates from the drum along a substantially vertical tangent line.

15. The printing system of claim 14, wherein the paper web separates from the drum and moves into a drying station before coming into contact with a turn-bar.

16. A method of printing, comprising the steps of:

printing a plurality of sense marks on a substrate, wherein consecutive sense marks are separated by a predetermined distance;

feeding the substrate onto a drum associated with an imaging unit, wherein the imaging unit includes a plurality of printheads positioned around a circumference of the drum;

driving the substrate past the plurality of printheads by the rotation of the drum;

detecting the sense marks with a single sensor associated with the plurality of printheads at a position where the substrate is in contact with the drum; and instructing the imaging unit to print images onto a portion of the substrate that is in contact with the drum, wherein the instructing step distributes print data among the plurality of printheads in the imaging unit in accordance with the detection of the sense marks by only the single sensor.

17. The method of claim 16, wherein the sense marks indicate a top of page or a bottom of page.

18. The method of claim 16, wherein the instructing step distributes the print data among the plurality of printheads in accordance with the detection of the sense marks and the angular velocity of the drum, and further comprising the step of tracking the positions of multiple sense marks.

19. The method of claim 16, wherein the substrate is a paper web driven past the plurality of print heads by the rotation of the drum.

20. The method of claim 19, further comprising the step of printing images onto the paper web in accordance with the instructing step, wherein the second printing step is capable of printing data on substantially the entire width of the paper web, including the portion wherein the sense marks are printed.

21. The method of claim 19, further comprising the steps of feeding the paper web onto a second drum associated with a second imaging unit, and instructing the second imaging unit to print images onto the substrate, wherein the first imaging unit prints images onto a first side of the paper web and the second imaging unit prints images onto a second side of the paper web, and wherein the instructing step distributes print data among a plurality of printheads in the second imaging unit so that the images printed by the first and second imaging units are aligned.

22. The method of claim 21, further comprising the step of detecting the sense marks at the second imaging unit at a position before the paper web is in contact with the second drum.

23. The method of claim 21, further comprising the step of detecting the sense marks at the second imaging unit after the paper web is in contact with the second drum, wherein the printing step prints sense marks on both sides of the paper web.

24. The method of claim 21, further comprising the step of detecting the sense marks at the second imaging unit after the paper web is in contact with the second drum, wherein the printing step prints the sense marks on only one side of the paper web in infrared or invisible ink.

25. The method of claim 19, wherein the paper web is in contact with the surface of the drum along greater than 180 degrees.

26. The method of claim 25, wherein the paper web is in contact with the surface of the drum along about 270 degrees.

27. A printing system, comprising:

a sense mark printer that prints only a plurality of sense marks on a paper web, wherein consecutive sense marks are separated by predetermined distances;

an imaging unit that prints images on the paper web, wherein the imaging unit includes a plurality of printhead assemblies;

a drum that drives the paper web past the printhead assemblies;

a single sensor associated with the plurality of printhead assemblies that detects the sense marks after the paper web has contacted the drum; and a controller that instructs the printhead assemblies to print images onto the paper web, wherein the controller tracks the position of multiple sense marks concurrently and accounts for the speed of the paper web so that the printhead assemblies print images onto the paper web in accordance with the sense marks by only the single sensor.

28. The printing system of claim 27, further comprising a second imaging unit that prints images on the paper web downstream from the first imaging unit, wherein the second imaging unit includes a plurality of printhead assemblies, and wherein a second sensor at the second imaging unit detects the sense marks before the paper web has contacted a second drum that drives the paper web past the printhead assemblies associated with the second imaging unit.

29. The printing system of claim 27, further comprising a second imaging unit that prints images on the paper web downstream from the first imaging unit, wherein the second imaging unit includes a plurality of printhead assemblies, and wherein a second sensor at the second imaging unit detects the sense marks after the paper web has contacted a second drum that drives the paper web past the printhead assembles associated with the second imaging unit.

30. The printing system of claim 29, wherein the sense marks are printed on one side of the paper web in infrared or invisible ink.

* * * * *